United States Patent [19]

Chenevard

[11] 4,048,780

[45] Sept. 20, 1977

[54] METHOD AND APPARATUS FOR PLACING OBJECTS INTO BOXES

[75] Inventor: Alexis Chenevard, Morges, Switzerland

[73] Assignee: SAPAL Societe Anonyme des Plieuses Automatiques, Switzerland

[21] Appl. No.: 718,563

[22] Filed: Aug. 30, 1976

[30] Foreign Application Priority Data

Oct. 27, 1975 Switzerland ..... 13901/75

[51] Int. Cl.[2] ..... B65B 5/08; B65B 35/38

[52] U.S. Cl. ..... 53/26; 53/35; 53/159; 53/247

[58] Field of Search ..... 53/26, 35, 155, 159, 53/166, 238, 247

[56] References Cited

U.S. PATENT DOCUMENTS

| | | | |
|---|---|---|---|
| 3,499,262 | 3/1970 | Thurston et al. | 53/238 |
| 3,920,128 | 11/1975 | Baker | 53/247 |

FOREIGN PATENT DOCUMENTS

| | | | |
|---|---|---|---|
| 712,710 | 9/1966 | Italy | 53/247 |

*Primary Examiner*—Robert Louis Spruill

*Attorney, Agent, or Firm*—Stevens, Davis, Miller, & Mosher

[57] ABSTRACT

Sets of objects such as cupped chocolates are deposited by templates on a table where each set is held by suction with the objects spaced apart from another. A frame with movable walls brings together each set of objects which are lifted by a suction head forming a bell with the closed frame, and the set of objects is then deposited in a box.

11 Claims, 8 Drawing Figures

METHOD AND APPARATUS FOR PLACING OBJECTS INTO BOXES

The invention relates to the placing of sets of objects, such as chocolate assortments, into boxes.

It is known to use base modules of moulded plastics material having recesses for receiving products such as, for example, wrapped or unwrapped chocolates, these base modules firstly being filled with chocolates and then being placed in assortment boxes. This method, however, does not enable the chocolates to be placed against one another in the boxes.

Various methods have been proposed for placing products such as chocolates in boxes, close to one another in controlled positions. One method previews the successive insertion of the products in boxes moving continuously in such a manner that the products are deposited at the same point in each of the successive boxes.

In another method, the products are brought between mobile plates and are deposited in contiguous rows in the boxes which are moved laterally to receive the contiguous rows.

The invention aims to provide a simple method permitting all of the objects of a set to be simultaneously deposited in a box.

The method according to the invention comprises disposing a set of objects in a template, holding the objects on a table by suction, removing the template, bringing mobile walls about the objects held on the table, moving the walls against the objects to bring the objects together into an area corresponding to an inner space of a box which is to receive the objects, and depositing the set of objects in the box.

The invention also provides an apparatus for placing sets of objects, such as assortments of chocolates, in boxes, comprising templates each able to receive a set of objects to be placed in a box, pneumatic means for holding the objects by suction on a table, means for cyclically moving the templates to each deposit a set of objects on the table and remove the template from the deposited objects, mobile walls which can be brought about a set of objects held on the table and moved against the objects to bring them together into an area corresponding to an inner space of a box which is to receive the objects, and means for conveying the walls together with a set of objects and depositing the set of objects in one operation in a box.

The term object is used herein to designate any unwrapped or wrapped article, such as sweets and food products in general, and in particular articles disposed in a known type of cup of sheet material having a folded trunco-conical wall, for example a chocolate placed or moulded in such a cup.

The accompanying drawings schematically illustrate, by way of example, a manner of carrying out the method according to the invention as well as an apparatus used for carrying out this method. In the drawings.

The method schematically illustrated in FIGS. 1 to 5 serves for the placing, in boxes, of sets of chocolates contained in paper cups 1 with folded walls of known type. Instead of being in paper, these cups could be in other sheet materials, notably of metal or plastics material.

Figure 5:
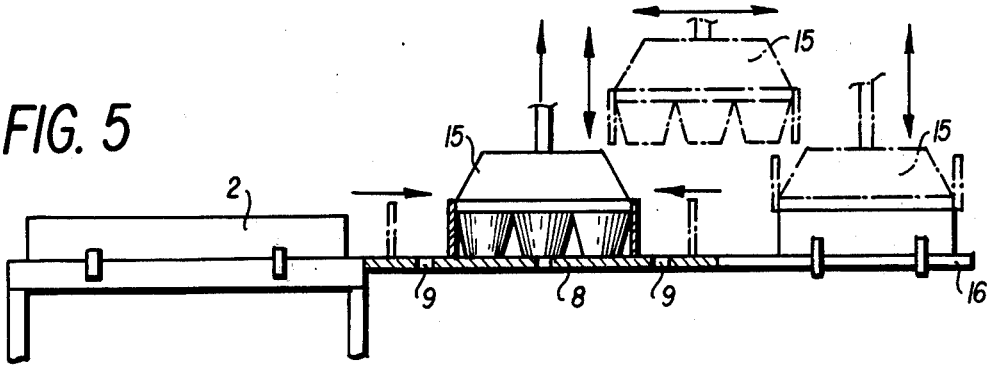
FIG. 5 is a view similar to FIG. 4 during a subsequent phase of the method.
Figure 4:
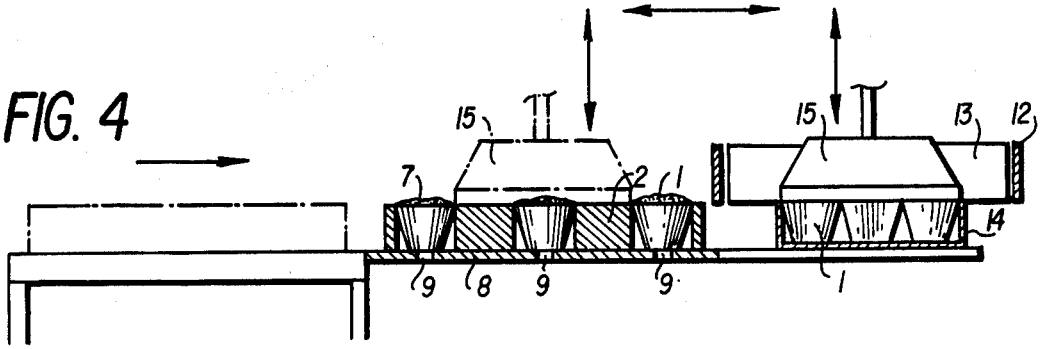
FIG. 4 is a cross-section along line B—B of FIG. 1.
Figure 6:
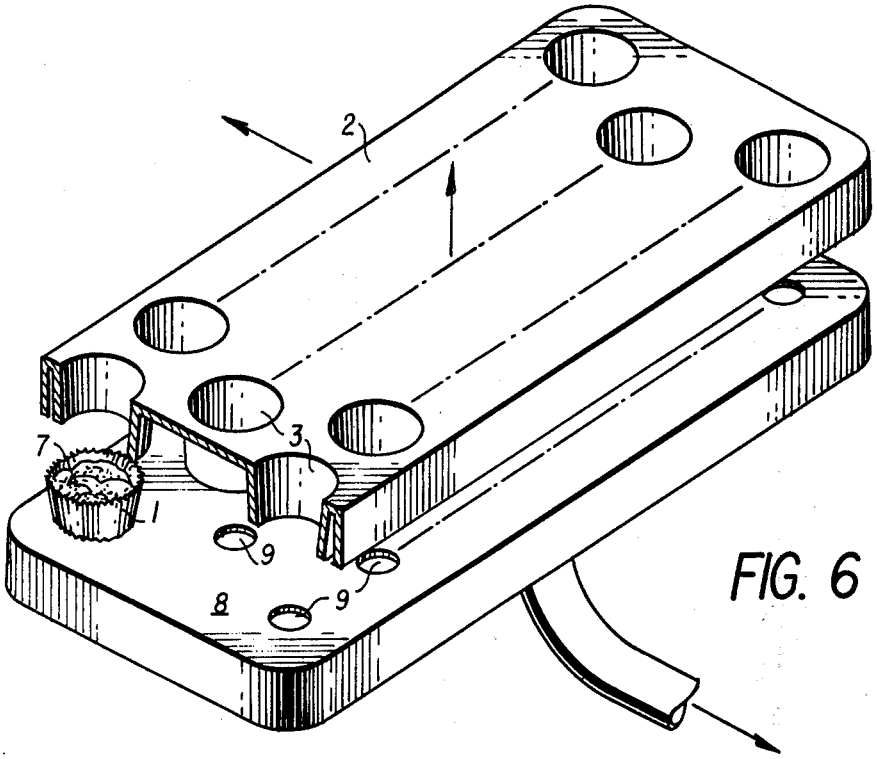
FIG. 6 is a partly-cut-away perspective view of a detail of the apparatus.

The cups 1 are firstly placed in a template 2, for example of plastics material, having openings 3 which, although they are shown in FIGS. 1 to 5 as circular and six in number, could have other shapes and be of greater number (see FIG. 6). Each empty template 2 is brought onto a comb conveyor 4 having driving arms disposed with an equal pitch and which moves in the direction of arrow I to a station 5 placing cups 1 in the openings 3 in a known manner, then to a station 6 placing chocolates 7 in cups 1. The chocolates are disposed in the cups in the manner described in Swiss Pat. No. 584,132 for filling base modules of assortment boxes with products of different sorts.

The apparatus could alternatively have a station 6 delivering templates 2 filled with cups already containing moulded chocolates.

Figure 3:
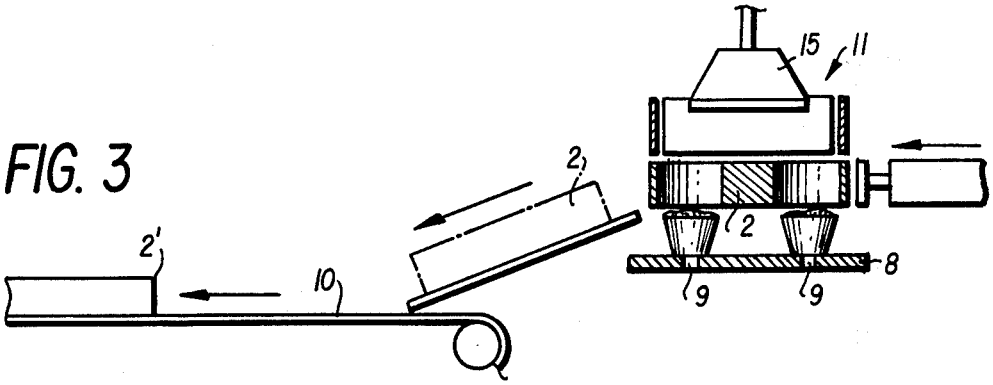
FIG. 3 is a view similar to FIG. 2 during a subsequent phase.

The template 2 carrying the cups 1 with chocolates 7 is then brought onto a table schematically shown at 8 in FIGS. 2 to 6. Table 8 has an array of suction holes 9 corresponding to the disposition of the objects, i.e. cups 1 with chocolates 7, in the template 2. The cups 1 with chocolates 7 are held by suction on the table 8, and then the template 2 is removed by a mechanical lifting and pusher device as shown in FIG. 3 and is placed on a conveyor 10 and returned in the direction of arrow II to cyclically repeat the above-described cycle of operations, 2' (FIGS. 2 and 3) designating the preceding template.

A rectangular frame 11 with mobile transverse walls 12 and mobile longitudinal walls 13 (FIG. 2) is brought above the cups 1 with their chocolates 7 (FIG. 3) and lowered, the walls of frame 11 moving together, after the template 2 has been removed, into a joined or closed position (FIG. 5) in which the cups 1 and chocolates 7 are brought together into a rectangular area slightly smaller than the space of a box 14 to be filled.

Figure 1:
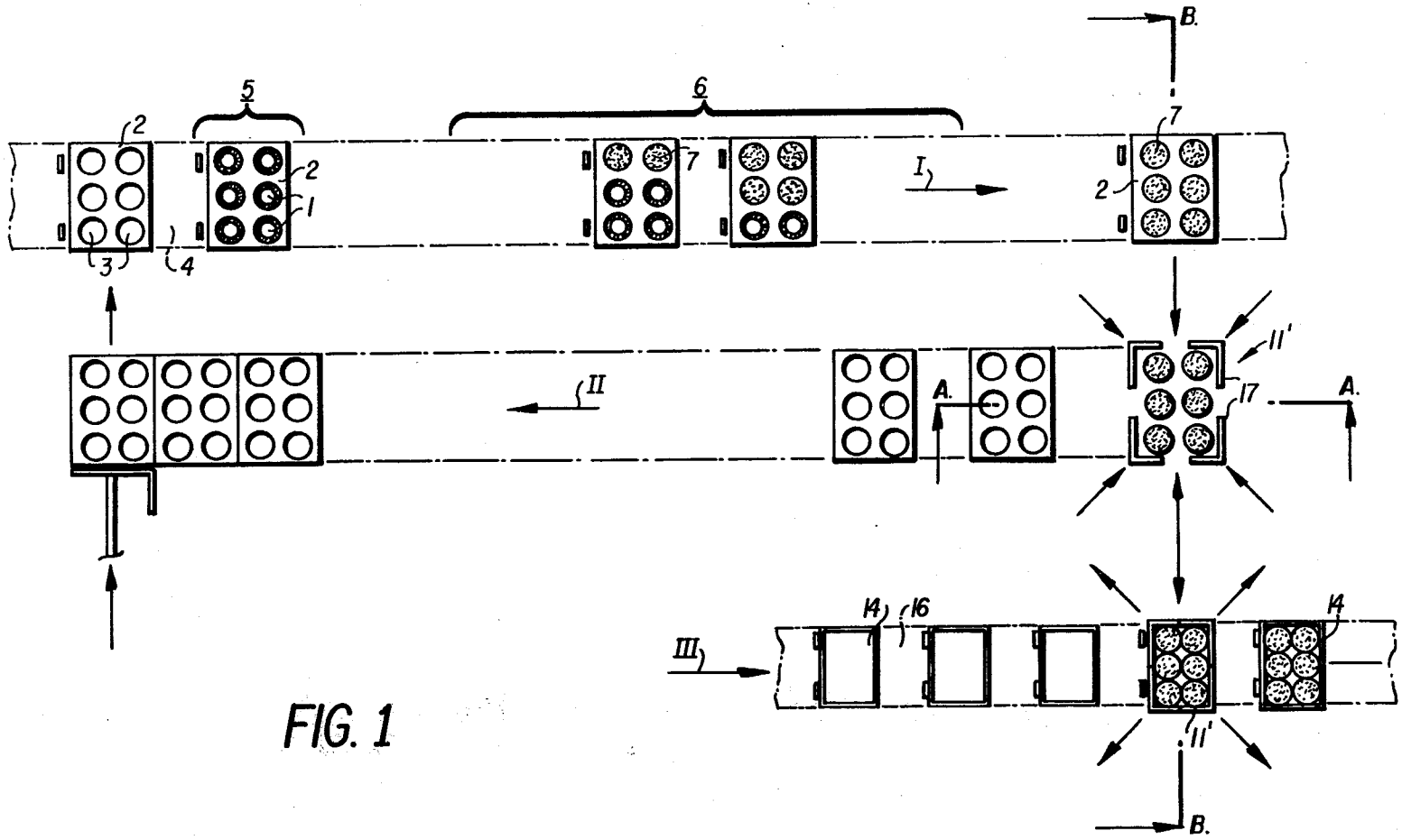
FIG. 1 is a schematic plan view of the apparatus illustrating various phases of the method.
Figure 2:
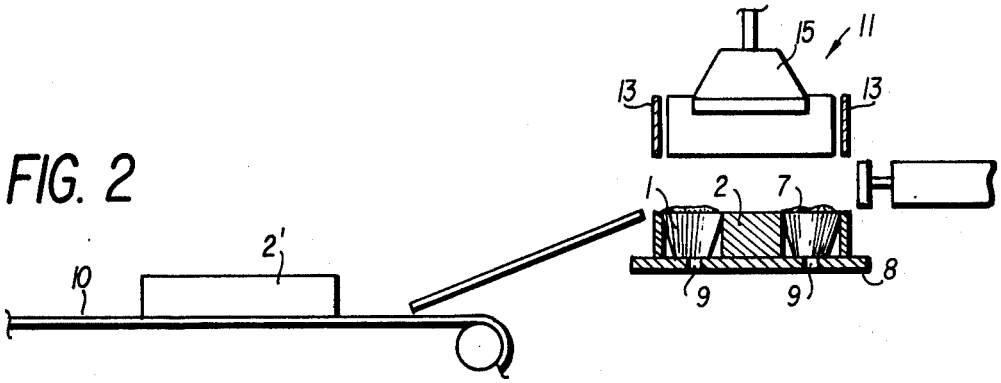
FIG. 2 is a cross-section to enlarged scale along line A—A of FIG. 1, during one phase of operation.

A suction head 15 is applied on the closed frame 11 (FIGS. 4 and 5) to form a bell which lifts up the set of cups 1 with their chocolates 7 when they are gripped in the closed frame 11. FIG. 5 illustrates the movements of the bell 15-11 vertically and horizontally to bring it to a filling station above a box 14 carried by a conveyor 16 moving intermittently in the direction of arrow III as illustrated in FIG. 1. The frame 11 is then opened, the suction cut off and the set of cups 1 with their chocolates are deposited in one operation in the box 14. The described operations are repeated cyclically with successive templates and boxes.

In FIG. 1, the rectangular frame 11 with mobile walls is formed of four right-angled dihedrons 17 movable in the direction of diagonals of the rectangle in such a manner that in the closed position of the frame 11 the inner dimensions thereof are slightly less than those of the box 14 to facilitate it being filled.

Figure 7:
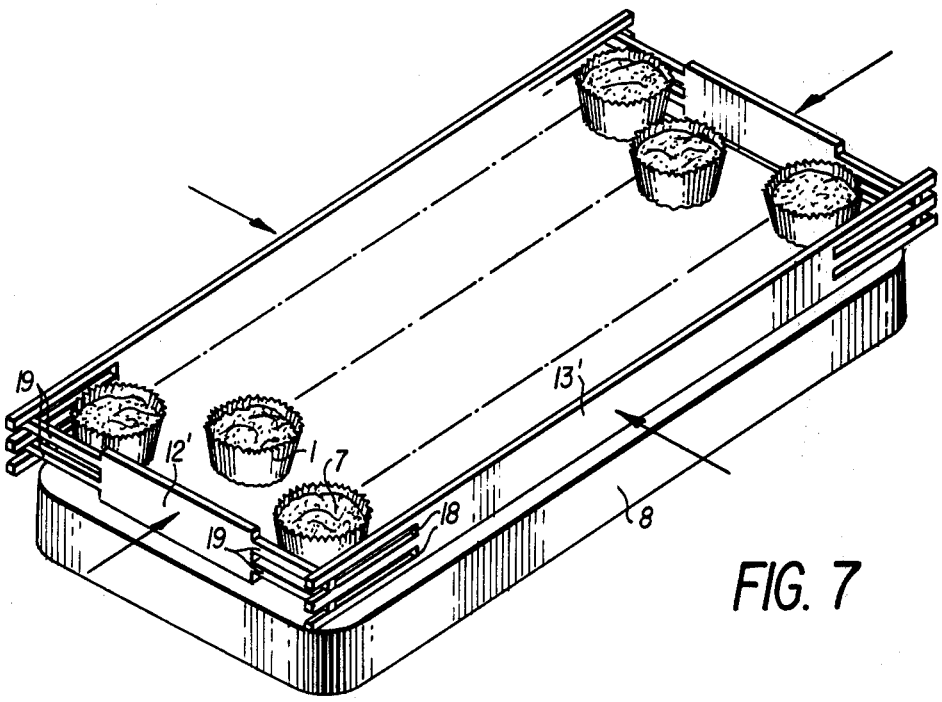
FIG. 7 is a perspective view of another detail of a modified form of apparatus.
Figure 8:
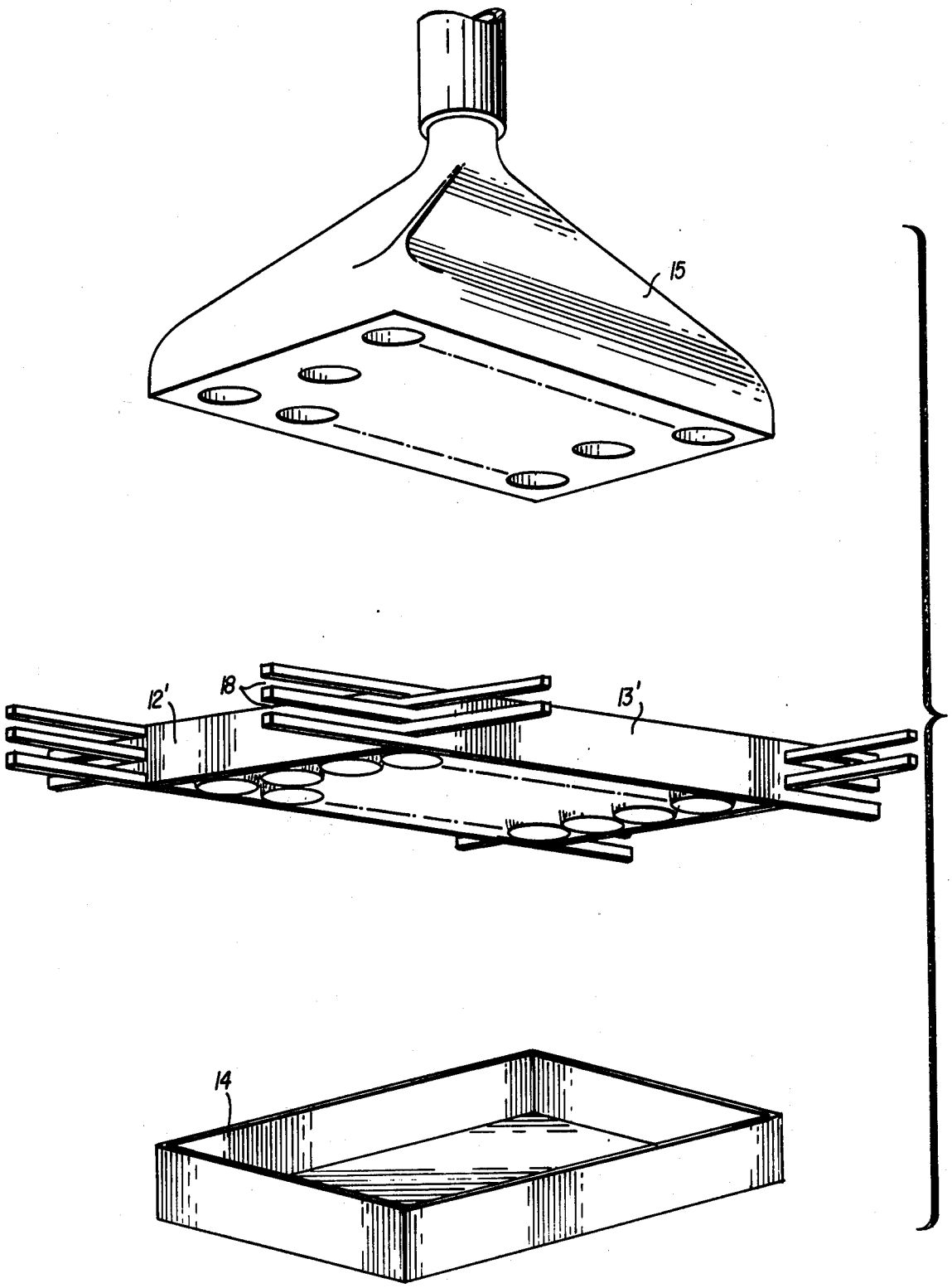
FIG. 8 is an exploded perspective view of part of this modified form of apparatus during another phase of the method.

FIGS. 7 and 8 show a varied form of rectangular frame with mobile longitudinal walls 13' and transverse walls 12' whose ends are slotted at 18, 19 respectively and slidably fitted in one another at right angles to be able to modify the inner space of the frame, the dimensions of this closed frame being slightly smaller than those of the box 14 to be filled. FIG. 7 shows the frame 12', 13' open with the cups 1 and chocolates 7 held on the table 8 in the position in which they had been deposited by template 2. FIG. 8 shows the frame 12', 13' in the closed position with the suction head 15 above and the box 14 to be filled disposed below the assembly of the frame with the cups and chocolates. For the sake of clarity of the drawing, the head 15 has been shown separated from the frame 12', 13', but in reality during transport the head 15 forms, with the frame, a suction bell as was described above in the preceding example. Likewise, at the moment of depositing the objects in the box 14, the frame 12', 13' comes into contact with the box.

Although templates and frames of rectangular shape have been described, it is clear that one could use elements of different shape adapted to other shapes of box.

What is claimed is:

1. A method of placing sets of objects, such as assortments of chocolates, in boxes, comprising disposing a set of objects in a template, conveying the objects disposed in the template to a table, holding the objects on the table by suction, removing the template, bringing mobile walls about the objects held on the table, moving the walls against the objects to bring the objects together into an area corresponding to an inner space of a box which is to receive the objects, gripping and conveying the thus assembled set of objects and depositing the set of objects in the box.

2. A method according to claim 1, in which each object comprises a product in a trunco-conical cup of sheet material with a folded wall, comprising depositing a set of cups in the template at a delivery station of a conveyor, placing a product in each cup, and conveying the template carrying the cups with the products onto said table where the cups are held by suction.

3. A method according to claim 1, in which each object comprises a product moulded in a trunco-conical cup in a sheet material with a folded wall, in which the cups with their moulded products are deposited automatically in the template at a delivery station of a conveyor, and the template is conveyed onto said table where the cups are held by suction.

4. A method according to claim 1, in which the template places the objects in the configuration of a rectangle on the table, and said walls are in the form of four mobile right-angled dihedral walls which are brought to the four angles of the rectangle formed by the objects held by suction on the table and simultaneously moved together in directions corresponding to diagonals of the rectangle to form a frame surrounding the objects.

5. A method according to claim 1, in which the template places the objects in the configuration of a rectangle on the table, and two longitudinal walls and two transverse walls are brought facing corresponding sides of the rectangular formed by the objects held by suction on the table and simultaneously moved together perpendicular to the respective sides of the rectangle.

6. A method according to claim 1, in which simultaneously with said movement of the walls, the objects are sucked from above, the assembly of walls and objects held by suction is moved above a box arriving at a filling station of a conveyor, and the set of objects is discharged into the box by opening the frame and interrupting the suction.

7. An apparatus for placing sets of objects, such as assortments of chocolates, in boxes, comprising templates each able to receive a set of objects to be placed in a box, pneumatic means for holding the objects by suction on a table, means for cyclically moving the templates to each deposit a set of objects on the table and remove the template from the deposited objects, mobile walls which can be brought about a set of objects held on the table and moved against the objects to bring them together into an area corresponding to an inner space of a box which is to receive the objects, means for conveying the walls together with a set of objects, and means for gripping and conveying the assembled set of objects and depositing the set of objects in one operation in a box.

8. An apparatus according to claim 7, comprising a first conveyor for bringing the templates to a station supplying the objects to be placed in the boxes, each object having a product-receiving trunco-conical cup of sheet material with a folded wall, a table onto which the filled templates are brought, said table having suction holes corresponding to the disposition of a set of objects in each template, a second conveyor for recycling empty templates, a suction head cooperating with the mobile walls when they are brought together into a closed frame to form a bell which lifts up to objects in the frame, and a third conveyor for bringing packing boxes to a station where the bell may be moved above a box to discharge a set of objects into it.

9. An apparatus according to claim 8, in which said frame is rectangular and is formed of longitudinal and transverse walls which are slotted and slidably fitted in one another at right angles to be able to modify the inner space of th frame, the inner dimensions of the closed frame being slightly smaller than those of the box in which the objects are deposited.

10. An apparatus according to claim 8, in which said frame is rectangular and is formed of four dihedrons movable along the direction of diagonals of the closed rectangular frame so that in the closed position of the frame, the inner dimensions thereof are slightly smaller than those of the box in which the objects deposited.

11. An apparatus according to claim 8, in which when the mobile walls are moved to the closed position they are joined to form a rectangular frame defining an inner rectangular space for the objects slightly smaller than that of the boxes to be filled.

* * * * *

REEXAMINATION CERTIFICATE (188th)

United States Patent [19]

Chenevard

[11] B1 4,048,780

[45] Certificate Issued Apr. 3, 1984

[54] METHOD AND APPARATUS FOR PLACING OBJECTS INTO BOXES

[75] Inventor: Alexis Chenevard, Morges, Switzerland

[73] Assignee: SAPAL Societe Anonyme des Plieuses Automatiques, Switzerland

Reexamination Request:
No. 90/000,317, Jan. 17, 1983

Reexamination Certificate for:

| | |
|---|---|
| Patent No.: | **4,048,780** |
| Issued: | **Sep. 20, 1977** |
| Appl. No.: | **718,563** |
| Filed: | **Aug. 30, 1976** |

[30] Foreign Application Priority Data

Oct. 27, 1975 [CH] Switzerland ..... 13901/75

[51] Int. Cl.³ ..... B65B 5/08; B65B 35/38

[52] U.S. Cl. ..... 53/448; 53/247; 53/473; 53/543

[58] Field of Search ..... 53/155, 238, 247, 443, 53/448, 473–475, 531, 534, 539, 543

[56] References Cited

U.S. PATENT DOCUMENTS

| | | | |
|---|---|---|---|
| 3,283,471 | 11/1966 | Thurston et al. | 53/55 |
| 3,456,424 | 7/1969 | Thurston et al. | 53/154 |
| 3,499,262 | 3/1970 | Thurston et al. | 53/124 |
| 3,920,128 | 11/1975 | Baker | 53/247 |

FOREIGN PATENT DOCUMENTS

| | | | |
|---|---|---|---|
| 712710 | 9/1966 | Italy | 53/247 |
| 299887 | 5/1929 | United Kingdom . | |
| 874917 | 8/1961 | United Kingdom . | |
| 874918 | 8/1961 | United Kingdom . | |

OTHER PUBLICATIONS

*Candy Industry*, Apr. 21, 1964, vol. 122, No. 8, pages: cover, 5, 16, 18, 19 and 54.

*Primary Examiner*—Robert Louis Spruill

[57] ABSTRACT

Sets of objects such as cupped chocolates are deposited by templates on a table where each set is held by suction with the objects spaced apart from another. A frame with movable walls brings together each set of objects which are lifted by a suction head forming a bell with the closed frame, and the set of objects is then deposited in a box.

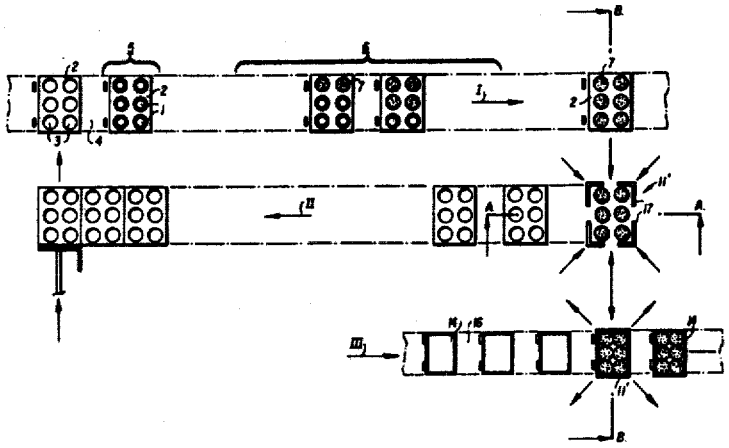

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 5 and 7, having been finally determined to be unpatentable, are cancelled.

Claims 4, 6, and 8 are determined to be patentable as amended:

Claims 9–11, dependent on amended claims, are determined to be patentable.

New claims 12–18 are added and determined to be patentable.

4. A method [according to claim 1, in which the] *of placing sets of objects, such as assortments of chocolates, in boxes, comprising disposing a set of objects in a template; conveying the objects disposed in the template to a table, said* template [places] *placing* the objects in the configuration of a rectangle on the table [, and]*; holding the objects on the table by suction; removing the template; bringing mobile walls about the objects held on the table,* said walls [are] *being* in the form of four mobile right-angled dihedral walls which are brought to the four angles of the rectangle formed by the objects held by suction on the table and simultaneously moved together in directions corresponding to diagonals of the rectangle to form a frame surrounding the objects [.]*; moving the walls against the objects to bring the objects together into an area corresponding to an inner space of a box which is to receive the objects; and gripping and conveying the thus assembled set of objects and depositing the set of objects in the box.*

6. A method [according to claim 1, in which] *of placing sets of objects, such as assortments of chocolates, in boxes, comprising disposing a set of objects in a template; conveying the objects disposed in the template to a table; holding the objects on the table by suction; removing the template; bringing mobile walls about the objects held on the table; moving the walls against the objects to bring the objects together into an area corresponding to an inner space of a box which is to receive the objects; and gripping and conveying the thus assembled sets of objects and depositing the set of objects in the box, said gripping, conveying and depositing step comprising sucking the objects from above* simultaneously with said movement of the walls, [the objects are sucked from above,] *moving* the assembly of walls and objects held by suction [is moved] above a box arriving at a filling station of a conveyor [,] and *discharging* the set of objects [is discharged] into the box by opening the frame and interrupting the suction.

8. An apparatus [according to claim 7,] *for placing sets of objects, such as assortments of chocolates, in boxes,* comprising *templates each able to receive a set of objects to be placed in a box;* a first conveyor for bringing the templates to a station supplying the objects to be placed in the boxes, each object having a product-receiving trunco-conical cup of sheet material with a folded wall [,]*;* a table onto which the filled templates are brought, said table having suction holes corresponding to the disposition of a set of objects in each template, [,]*; pneumatic means for holding the objects by suction on the table; means for cyclically moving the templates to each deposit a set of objects on the table and remove the template from the deposited objects;* a second conveyor for recycling empty templates [,]*; mobile walls which can be brought about a set of objects held on the table and moved against the objects to bring them together into an area corresponding to an inner space of a box which is to receive the objects; means for conveying the walls together with a set of objects; means for gripping and conveying the assembled set of objects and depositing the set of objects in one operation in a box, said means comprising* a suction head cooperating with the mobile walls when they are brought together into a closed frame to form a bell which lifts up [to] *the* objects in the frame [,]*;* and a third conveyor for bringing packing boxes to a station where the bell may be moved above a box to discharge a set of objects into it.

*12. A method according to claim 4, wherein the gripping, conveying and depositing step comprises applying suction to the objects from above simultaneously with the movement of the walls, moving the assembly of walls and objects held by suction above a box arriving at a filling station of a conveyor, and discharging the set of objects into the box by opening the frame and interrupting the suction.*

*13. A method according to claim 6, in which each object comprises a product moulded in a trunco-conical cup in a sheet material with a folded wall, in which the cups with their moulded products are deposited automatically in the template at a delivery station of a conveyor, and the template is conveyed onto said table where the cups are held by suction.*

*14. A method of placing sets of objects, such as assortments of chocolates, in boxes, comprising disposing a set of objects in a template, conveying the objects disposed in the template to a table, holding the objects on the table by suction, removing the template, bringing separated mobile wall sections about the objects held on the table, moving the wall sections together against the objects to form a frame around the objects and to bring the objects together into a pattern having a perimeter that defines an area slightly smaller than the surface area of the bottom of a box which is to receive the objects, and gripping and conveying the thus assembled set of objects and depositing the set of objects in the box; said gripping, conveying and depositing step comprising applying suction to the objects from above simultaneously with the movement of the wall sections, moving the assembly of wall sections and objects held by suction above a box arriving at a filling station of a conveyor, and discharging the set of objects into the box by opening the frame and interrupting the suction.*

*15. A method according to claim 14, in which each object comprises a product moulded in a trunco-conical cup in a sheet material with a folded wall, in which the cups with their moulded products are deposited automatically in the template at a delivery station of a conveyor, and the template is conveyed onto said table where the cups are held by suction.*

*16. An apparatus for placing sets of objects, such as assortments of chocolates, in boxes, comprising templates each*

*adapted to receive a set of objects to be placed in a box, pneumatic means for holding the objects by suction on a table, means for cyclically moving the templates to each deposit a set of objects on the table and remove the template from the deposited objects, separate mobile wall sections adapted to be brought about a set of objects held on the table and moved against the objects to form a frame around the objects and to bring the objects together into a pattern having a perimeter that defines an area slightly smaller than the surface area of the bottom of a box which is to receive the objects, means for conveying the walls together to form a frame around the set of objects, and means for gripping and conveying the assembled set of objects and the walls as one assembly and depositing the set of objects in one operation in a box; said means for gripping, conveying and depositing comprising a suction head cooperating with the mobile wall sections when they are brought together into a closed frame to form a suction bell which lifts up the set of objects in the frame.*

*17. An apparatus according to claim 16, further comprising a first conveyor for bringing the templates to a station supplying the objects to be placed in the boxes, each object having a product-receiving trunco-conical cup sheet material with a folded wall; a table onto which the filled templates are brought, said table having suction holes corresponding to the disposition of a set of objects in each template; a second conveyor for recycling empty templates; and a third conveyor for bringing boxes to a station where the bell may be moved above a box to discharge a set of objects into it.*

*18. A method according to claim 4, in which each object comprises a product moulded in a trunco-conical cup in a sheet material with a folded wall, in which the cups with their moulded products are deposited automatically in the template at a delivery station of a conveyor, and the template is conveyed onto said table where the cups are held by suction.*

* * * * *